United States Patent [19]

Storz

[11] 4,161,099

[45] Jul. 17, 1979

[54] DAY AND DATE INDICATOR FOR CLOCKS

[75] Inventor: Erwin Storz, Bad Durrheim, Fed. Rep. of Germany

[73] Assignee: Keinzle Uhrenfabriken GmbH, Schwenningen, Fed. Rep. of Germany

[21] Appl. No.: 854,310

[22] Filed: Nov. 23, 1977

[30] Foreign Application Priority Data

Mar. 8, 1977 [DE] Fed. Rep. of Germany ... 7707132[U]

[51] Int. Cl.[2] ..... G04B 19/24; G09D 3/08

[52] U.S. Cl. ..... 58/4 R; 40/115; 58/85.5

[58] Field of Search ..... 58/4 R, 4 A, 5, 58, 58/85.5; 40/111, 113, 115

[56] References Cited

U.S. PATENT DOCUMENTS

| | | | |
|---|---|---|---|
| 2,246,883 | 6/1941 | Harrison | 58/5 |
| 3,452,535 | 7/1969 | Cabantous | 58/58 |
| 3,608,300 | 9/1971 | Wingler | 40/111 |
| 4,027,468 | 6/1977 | Felty | 58/58 |

*Primary Examiner*—J. V. Truhe

*Assistant Examiner*—William L. Feeney

*Attorney, Agent, or Firm*—Pollock, VandeSande and Priddy

[57] ABSTRACT

A day and date indicator comprises a carrier structure which supports for rotation a flat, annular date disc and, within a recess in said date disc, a flat annular day disc. The inner peripheries of the two discs are provided with gear teeth that are adapted to be engaged by a cam driven by the clockwork mechanism and operative to advance each disc by a single increment once each day. The carrier structure is fabricated of a plastic material and includes resilient clamps and projections for attaching the carrier structure to the clockwork housing, integral resilient detents engaging the day and date discs to hold the discs in position when they are not being advanced by the cam, and a sleeve-like collar surrounding the indicator shaft of the clockwork mechanism for attaching the indicator to the housing of the clock. Each disc further includes a plurality of outstanding pins which can be engaged manually, or by a manually-operated setting mechanism, to set the two discs individually to desired indicating positions.

9 Claims, 5 Drawing Figures

DAY AND DATE INDICATOR FOR CLOCKS

BACKGROUND OF THE INVENTION

The present invention relates to a day and date indicator adapted to be attached to a clock for providing an indication of both the day and date during normal operation of the clock.

The date indicator structures have been suggested heretofore for attachment to large-sized clocks. These prior indicators have comprised a flat carrier structure having a date disc mounted thereon which is arranged and constructed to be advanced once a day through a single increment by means of a cam that is driven by the clockwork mechanism. The cam completes a single revolution every twenty-four hours, and is adapted to engage, once a day, internal gearing forming a portion of the date disc to provide the desired advance of the date disc. The flat carrier, fabricated of synthetic plastic material, is provided with a catch or detent element forming an integral portion of the carrier structure and operative to retain the date disc at its set position when it is not being advanced by the clockwork-driven cam.

The date indicators of this known, relatively simply construction, provide a date display only, and are not adapted to simultaneously display the day of the week. The object of the present invention is accordingly to provide an indicator which is no more complicated in design that the previously known date indicators discussed above, but which can, in addition to providing a date indication, also produce an indication of the day of the week. The structure is so designed that it can be installed without difficulty, and without any modification to the clock, on a clock intended to receive a date indicator of the type discussed above. The device is so constructed that it can be added to an existing clock as optional equipment.

SUMMARY OF THE INVENTION

The day and date indicator of the present invention comprises a carrier structure adapted to be attached to a clock adjacent its clockwork mechanism. The indicator includes a flat annular date disc which is supported by the carrier structure for rotation in a plane parallel to the face of the clock. The date disc includes a flat first portion adjacent its outer periphery having date indicia thereon, and also includes an inwardly stepped flat second portion defining an annular recess between said first portion and the inner periphery of the date disc. A flat annular day disc, bearing indicia relating to the days of the week, is located within said annular recess and is supported by the carrier structure for rotation in said recess in a plane parallel to the plane of the date disc.

The inner peripheral edges of the two discs are of like diameter and are provided with gear teeth which are adapted to be engaged by the rotatable clockwork-driven cam, so that when said cam completes its single rotation each day, it advances each of the two discs simultaneously through a single increment once each day. The carrier structure, which is preferably fabricated of a plastic material, includes a pair of resilient detents, preferably spaced from one another and from the cam by angles of substantially 120°, which respectively engage the two discs to hold them in their set positions when they are not being advanced by the clockwork-driven cam. The two discs further include a plurality of outstanding pins, on the side thereof opposite to the indicia-bearing sides of the discs, which can be engaged manually and/or by a manually-manipulative setting mechanism, to permit the two discs to be set individually to desired indicating positions.

The carrier structure includes elements adapted to facilitate attachment of the indicator to the clockwork mechanism and also to the housing of the clock, whereby the overall indicator device may be readily mounted on or removed from a clock as a unit when desired.

BRIEF DESCRIPTION OF THE DRAWINGS

The foregoing objects, advantages, construction and operation of the present invention will become more readily apparent from the following description and the accompanying drawings wherein.

DESCRIPTION OF THE PREFERRED EMBODIMENTS

Figure 4:
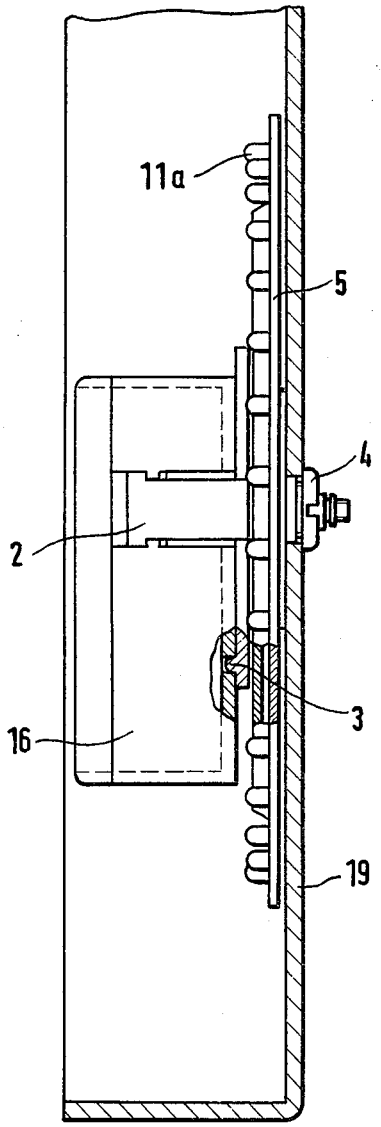
FIG. 4 is a cross-sectional view through the housing of a clock having a clockwork mechanism and indicator of the type shown in FIG. 1 mounted therein; and, FIG. 5 is a rear view of the assembly shown in FIG. 4.

The indicator of the present invention comprises a flat carrier structure 1 fabricated of a plastic material and having a pair of outwardly projecting substantially parallel clamp elements 2 projecting therefrom and adapted to resiliently engage the side walls of the clockwork case 16 to mount the carrier structure 1 and the elements associated therewith on the clockwork mechanism of a clock. The rear surface of the carrier structure 1 also includes a pair of outwardly protruding molded pegs 3 which are adapted to engage complementarily shaped recesses in the front surface of the clockwork case 16 (see FIG. 4) to assist in positioning the indicator; and said carrier structure includes, in addition, a sleeve-like collar 18 which is adapted to surround the indicator shaft 17 of the clockwork mechanism at a position closely adjacent the face of the clock, which cooperates with a fastening element 4 for securing the carrier structure to the housing 19 of the clock. Housing 19 (see FIG. 5) includes a window, not shown, of limited size for the viewing of day and date indicia which are positioned adjacent said window by movement of the day and date discs of the present invention.

The carrier structure 1 supports a date disc 5 for rotation thereon. Date disc 5 is of generally flat annular configuration and includes a flat portion adjacent its outer periphery which bears date indicia thereon, and an inwardly stepped substantially flat inner portion which extends from said outer, indicia-bearing portion of the disc 5 to the inner periphery of annular disc 5. A further annular disc 14, the so-called day disc, is located within the recess defined by the inwardly stepped portion of date disc 5, and extends from the outer edge of said recess to a radially inward location which is substantially diametrically equal to the inner periphery of the date disc 5. The outer indicia-bearing surface of day disc 14 is substantially co-planar with the indicia-bearing surface of date disc 5 due to the recess configuration of disc 5, and day disc 14 is also mounted for rotation about carrier structure 1, with the radial support of the two discs 5 and 14 being provided by the cylindrical part 7 of the carrier structure.

Figure 1:
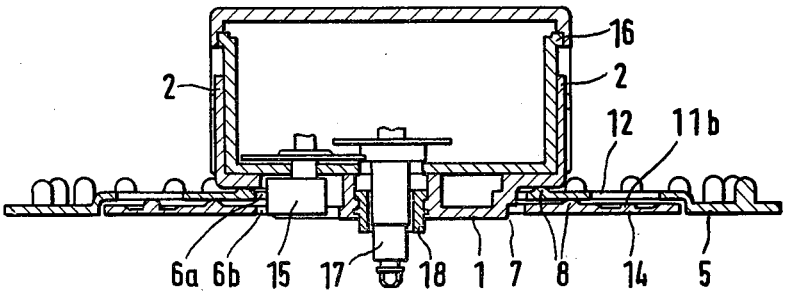
FIG. 1 is a cross-sectional view of a day and date indicator constructed in accordance with the present invention, and of the clockwork case to which the indicator is adapted to be connected.
Figure 2:
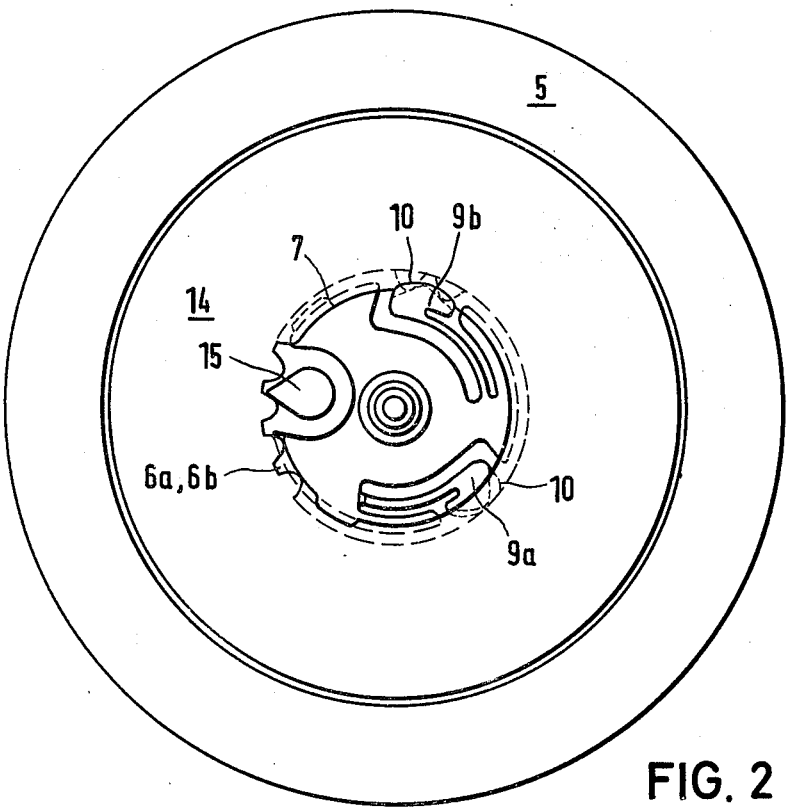
FIG. 2 is a front view of the indicator structure shown in FIG. 1.
Figure 3:
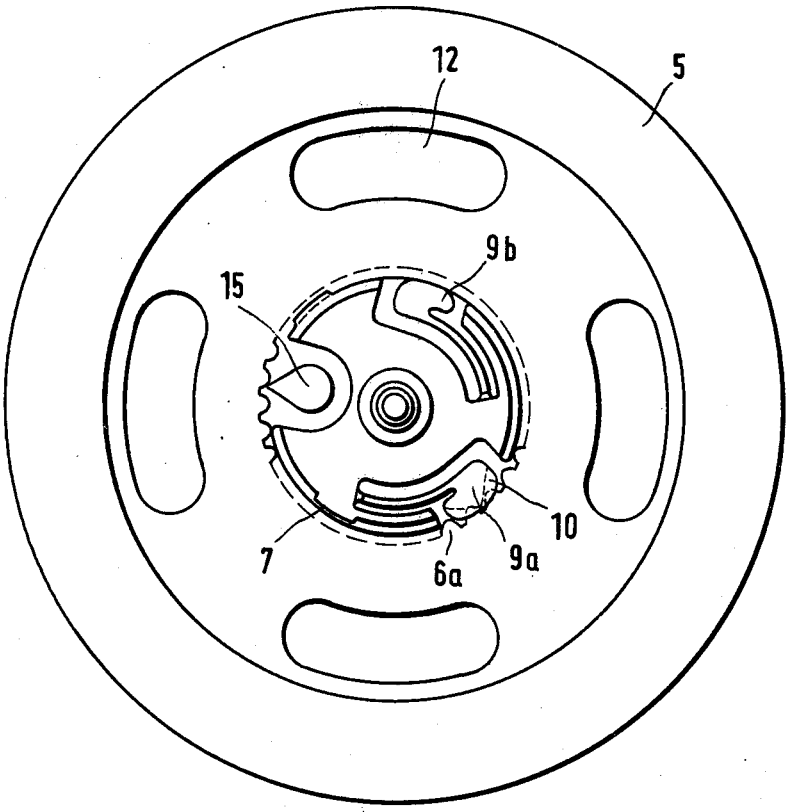
FIG. 3 is a front view of the indicator structure, similar to FIG. 2, but with the day disc removed.

The inner periphery of disc 5 is formed to define a plurality of gear teeth 6*a*, and the inner periphery of day disc 14 is similarly formed to define a plurality of gear teeth 6*b*, the two sets of internal gear teeth 6*a* and 6*b* being disposed in closely spaced superposed relation to one another at substantially the same radial distance from the axial center of carrier structure 1. These two sets of teeth 6*a* and 6*b* are adapted to be engaged simultaneously by a cam 15 which is mounted on a shaft having a toothed wheel meshing with a pinion on the hour hand shaft 17 of the clockwork mechanism as shown in FIG. 1. The hour hand shaft rotates through one revolution in twelve hours and operates to rotate the cam shaft through a single revolution once each day. As shown in FIGS. 2 and 3, cam 15 revolves about an axis which is disposed between the axial center of the carrier structure and the inner peripheries of the two annular discs 5, 14, and includes an outwardly extending projection which is adapted to engage the gear teeth 6*a*, 6*b* once each day to advance each of said discs through a single increment. In the preferred embodiment of the invention, the gearing 6*a* of the date disc 5 has 31 teeth, while the internal gearing 6*b* of day disc 14 has 21 teeth.

Carrier structure 1 is further provided with a pair of detents 9*a* and 9*b* which are spaced from one another and from cam 15 by angles of substantially 120°, and each detent is integral with the carrier structure 1 and is attached thereto by an elongated neck portion (see FIGS. 2 and 3) so that the detents are resiliently flexible relative to the remainder of carrier structure 1. Detent 9*a* is shaped and positioned to overlap and engage the date disc 5 adjacent the internal gearing thereof, while detent 9*b* is, in addition to being angularly spaced from detent 9*a*, also axially spaced from said detent 9*a* so as to overlap and engage the day disc 14 adjacent its inner gearing. The two detents 9*a* and 9*b* operate to hold their respective discs in a particular set position when the discs are not being positively advanced by cam 15, and are each so shaped and constructed that they can flex inwardly to permit the discs 5 and 14 to be rotated by cam 15 when the outwardly projecting portion of cam 15 comes into engagement with gear teeth 6*a*, 6*b*.

The side of the day disc 14 remote from the indicia bearing side thereof includes a plurality of dome-like projections 8 which bear on the forward surface of the inwardly recessed portion of date disc 5, and the rear surface of date disc 5 in turn includes a plurality of similar dome-shaped projections 8 which bear on the adjacent portion of carrier structure 1. Projections 8 thus operate to provide a certain axial spacing between carrier 1, disc 5 and disc 14, and provide bearing surfaces of limited extent between these various elements which permit them to rotate relative to one another with a minimum of frictional restraint.

The rear surfaces of discs 5 and 14 are provided, respectively, with further pluralities of pin-shaped protrusions 11*a*, 11*b* which are used to facilitate manual setting of the two discs to desired positions from the rear side of each disc. The protrusions 11*a*, 11*b* are located, respectively, on circular loci. The locus of protrusions 11*a* is disposed adjacent the outer periphery of disc 5 (see especially FIGS. 4 and 5) while the locus of pins 11*b* is located within the recessed portion of disc 5. In order to provide access to protrusions 11*b*, to permit day disc 14 to be set to a desired position from the rear of the indicator, date disc 5 is provided with a plurality of elongated slots 12 (see FIGS. 1, 3 and 5) overlying the locus of protrusions 11*b* to expose groups of protrusions 11*b* and to permit them to be manually engaged by the finger of an operator wishing to set disc 14 to a desired position.

Date disc 5 could be similarly set to a desired position by manual engagement of the pin-like protrusions 11*a* from the rear of the clock. In the preferred embodiment of the invention, however, the setting of the date disc 5 is accomplished by a manually operable setting device of the type shown in FIG. 5.

Figure 5:
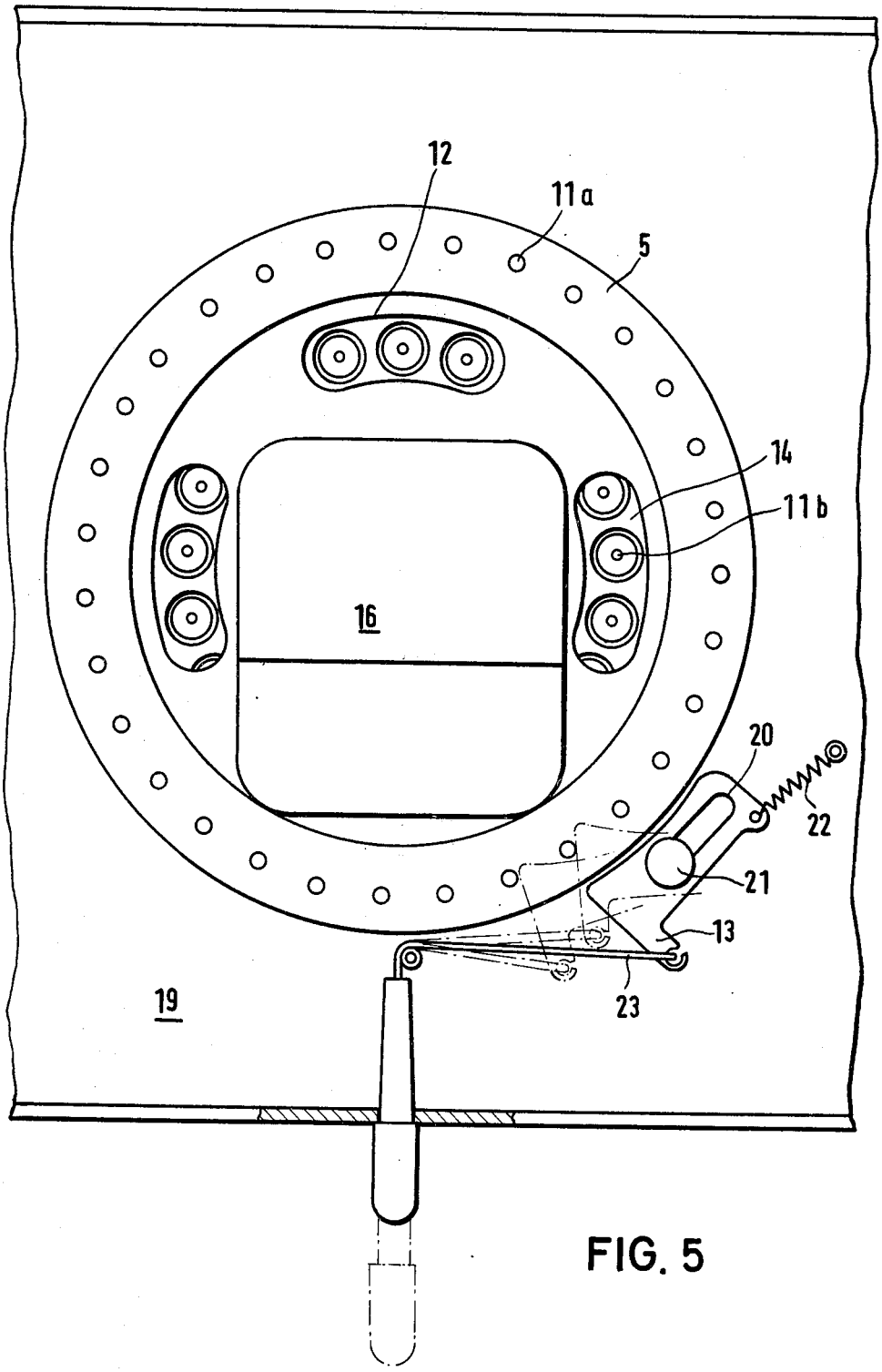

The setting device comprises a lever structure 13 which includes an elongated slot 20 therein. A pin or pivot structure extends from housing 19 through slot 20. A spring 22 is connected between one end of the lever 13 and housing 19 and operates to resiliently urge lever 13 to a position wherein pin 21 is in engagement with the lower end of slot 20 as illustrated in FIG. 5. A cord 23 is attached to the other end of the lever 13 and extends to a manually operable handle which projects outwardly of case 19.

When the handle is pulled downwardly (as shown in broken line in FIG. 5) the force of spring 22 initially inhibits any sliding motion between pin 21 and slot 20, and lever 13 accordingly rotates through a limited arc about pin 21 toward pin-like protrusions 11*a* on disc 5. As the handle continues to be pulled down, lever 13 moves in a substantially tangential direction relative to disc 5 as slot 20 moves along pin 21, so that the lever 13, while still in engagement with one of the protrusions 11*a*, advances disc 5 through a single increment. When the manual force applied to the handle is released, spring 22 returns lever 13 to the quiescent position shown in FIG. 5.

Having thus described my invention I claim:

1. A day and date indicator for clocks, comprising a carrier structure adapted to be attached to said clock adjacent the clockwork mechanism of said clock, said clockwork mechanism having at least one indicator shaft extending outwardly from said mechanism toward the face of said clock for moving the hands of said clock, a flat annular date disc extending parallel to the face of said clock and supported by said carrier structure for rotation about said indicator shaft, said date disc having an outer surface bearing date indicia thereon, a flat annular day disc supported by said carrier structure for rotation about the axis of said indicator shaft in a plane parallel to the plane of said date disc, said day disc having a flat surface bearing indicia thereon indicating the days of the week, the inner peripheral edge of said annular date disc being disposed closely adjacent to and having substantially the same diameter as the inner peripheral edge of said annular day disc, said two inner peripheral edges of said discs each having a plurality of gear teeth adapted to cooperate with a rotatable cam driven by said clockwork mechanism, said cam being located radially inward of the gear teeth of both said discs when said carrier structure is attached to said clock and including an eccentric portion shaped to periodically engage gear teeth of both of said discs for simultaneously advancing both of said discs in periodic step-by-step motion in the same direction of rotation about said indicator shaft, the side of each of said discs opposite to the indicia bearing side thereof including a plurality of outwardly projecting pins disposed in a circular locus for use in selectively setting the disc to a desired indicating position, said date disc including slots therein to provide access through said date disc to the outwardly projecting pins of said day disc for purposes of setting said day disc, and detent means extending from said carrier structure adjacent the inner peripheral edges of said day and date discs in angularly spaced relation to said cam, said detent means resiliently engaging said day and date discs respectively to hold said discs in their respective set positions when said discs are not being advanced by said cam.

2. The indicator of claim 1 wherein said date disc includes a flat first portion adjacent its outer periphery having said date indicia on an outer surface thereof, said date disc also including an inwardly stepped flat second portion defining an annular recess between said first portion and the inner periphery of said date disc, said flat annular day disc being located within said annular recess with the indicia-bearing surface of said day disc being substantially co-planar with the indicia-bearing surface of said date disc.

3. The indicator of claim 1 wherein said detent means comprise two resilient detents extending from said carrier structure for engagement with the gear teeth of said two discs respectively, said two detents being angularly spaced from one another and from said cam by angles of substantially 120°.

4. The indicator of claim 3 wherein said carrier structure is fabricated from a plastic material, said detents comprising integral plastic projecting portions of said carrier structure, each of said detents being shaped to resiliently overlap a portion of its associated disc.

5. The indicator of claim 1 wherein the side of each of said discs opposite to the indicia-bearing side thereof includes a plurality of spaced dome-shaped projections for minimizing the frictional engagement between each of said discs and the adjacent portion of said indicator.

6. The indicator of claim 1 wherein said carrier structure includes a pair of resilient clamps for engagement with the sides of the clockwork mechanism of said clock to attach said indicator to said clock.

7. The indicator of claim 6 wherein said carrier structure includes a plurality of outstanding pegs adapted to seat in complementarily shaped recesses in the front of the clockwork mechanism of said clock to assist in attaching said indicator to said clock.

8. The indicator of claim 6 wherein said clock includes a housing, said carrier structure including a collar adapted to surround the indicator shaft of said clockwork mechanism adjacent a portion of said housing, and removable fastening means adapted to engage said collar for affixing said indicator to said housing.

9. The indicator of claim 1 wherein said clock includes a housing, means mounted in said housing adjacent the outwardly projecting pins of said date disc for setting said date disc to a desired indicating position, said last-named means including a lever having an elongated slot therein, a pivot extending from said housing through said slot, spring means engaging one end of said lever, and a cord connected to the other end of said lever, whereby a manual pulling force applied to said cord initially causes said lever to rotate through an arc about said pivot toward and into engagement with at least one of said outwardly projecting pins and thereafter to slide along said pivot in said slot against the force of said spring means while in engagement with said pin to advance the indicating position of said date disc.

* * * * *